US006174099B1

(12) United States Patent
Patel et al.

(10) Patent No.: US 6,174,099 B1
(45) Date of Patent: Jan. 16, 2001

(54) DEVICE FOR APPLYING LIQUID COSMETIC PRODUCTS

(75) Inventors: Manhar Kantibhai Patel, Saddle Brook; Leo Clifford Pires, Basking Ridge; Barbara Bone Poder; Albert Joseph Stiso, both of Brick, all of NJ (US)

(73) Assignee: Revlon Consumer Products Corporation, New York, NY (US)

( * ) Notice: Under 35 U.S.C. 154(b), the term of this patent shall be extended for 0 days.

(21) Appl. No.: 09/517,322

(22) Filed: Mar. 2, 2000

(51) Int. Cl.[7] ..... A46B 11/00
(52) U.S. Cl. ..... 401/129; 401/126; 401/118
(58) Field of Search ..... 401/129, 126, 401/123, 124, 122, 118, 119, 48

(56) References Cited

U.S. PATENT DOCUMENTS

| | | | |
|---|---|---|---|
| 2,119,646 | 6/1938 | Pidel | 15/134 |
| 2,168,179 | 8/1939 | Tobey | 15/133 |
| 2,869,162 | 1/1959 | Dritz | 15/124 |
| 3,220,619 | 11/1965 | Lodding | 222/416 |
| 3,764,221 | 10/1973 | Solenghi | 401/129 |
| 4,447,169 | 5/1984 | Vartoughian | 401/269 |
| 4,710,048 | 12/1987 | Vartoughian | 401/269 |
| 4,854,759 | 8/1989 | Morane | 401/119 |
| 5,811,060 | 9/1998 | Laguna | 422/102 |
| 5,961,238 * | 10/1999 | De Bruin et al. | 401/129 |

FOREIGN PATENT DOCUMENTS

| | | | |
|---|---|---|---|
| 199111 * | 8/1958 | (AT) | 401/123 |
| 788263 * | 12/1957 | (GB) | 401/124 |

* cited by examiner

*Primary Examiner*—David J. Walczak
(74) *Attorney, Agent, or Firm*—Julie Blackburn

(57) ABSTRACT

A device for storing and applying cosmetic product comprising a container having a neck, and a cap for the container having a top end and a bottom end, the cap having affixed thereto a rod and applicator, wherein the rod is a hollow stem having a proximal and distal end, wherein the proximal end is attached to the cap inner surface and the distal end has an applicator affixed thereto; wherein the top end and bottom end of the cap have inner and outer surfaces, wherein the bottom end inner surface of the cap is designed to mate with the outer surface of the container neck when the container is in the closed position, causing the applicator to be immersed in the cosmetic liquid, and the top end inner surface of the cap is designed to mate with the container neck to form a unitary application device when the applicator is being used to apply cosmetic to a substrate.

14 Claims, 9 Drawing Sheets

DEVICE FOR APPLYING LIQUID COSMETIC PRODUCTS

TECHNICAL FIELD

The invention is in the field of cosmetic applicators comprised of a container for holding the cosmetic and an applicator for applying the cosmetic.

BACKGROUND OF THE INVENTION

The application of cosmetic liquids such as nail enamel involves dipping the brush into the nail enamel container to load it with product and applying it to the nails until the product on the brush is used up. Generally a brush loaded with product will cover one nail at most. The user is then forced to repeatedly dip the brush into the product to reload it. Such an application system causes increased exposure of the liquid cosmetic product to air, resulting in evaporation of the solvents found therein. Also, the repeated dipping of the brush provides increased chances for contaminants to be introduced into the liquid product.

Certain devices have been designed that minimize the necessity of repeated dipping of the brush to reload it with product. For example, U.S. Pat. No. 4,854,759 teaches a device for applying liquid product that enables use for a longer period of time. The rod/brush assembly attached to the cap inner surface is encased within a sheath which holds excess liquid so that as the liquid is applied to the nails from the brush, the excess liquid in the sheath migrates down into the brush to replace the liquid applied to the nails. This device is still a two part system, however, and the cosmetic product is exposed to air as long as the nails are being polished.

U.S. Pat. Nos. 2,119,646 and 2,168,179 teach liquid applicator devices having a dual function cap with a stem and applicator attached thereto. When the cap is affixed to the container when it is in the closed position, the applicator is immersed in the liquid material. When it is desired to apply the liquid material, the cap is removed, inverted, and re-affixed to the container so that the applicator extends outwardly. The liquid flows through the cap onto the applicator and is applied to the desired surface. When the application is completed, the cap is reaffixed to the container in the usual fashion. The applicators taught in these patents are not for liquid cosmetic products. Moreover, it does not appear that cap or applicator assembly has any mechanism for providing the appropriate load of product.

Accordingly, there is a desire for a container and applicator system for liquid cosmetic products that obviates the need for repeated loading of product onto the applicator, and which minimizes the exposure of the cosmetic product to the air. At the same time the device should provide proper loading of the liquid cosmetic onto the applicator.

The object of the invention is to provide a unitary container and applicator to be used for application of liquid cosmetic product to skin, hair, or nails.

Another object of the invention is to provide a liquid cosmetic container and applicator that causes minimal exposure of the liquid cosmetic product to the air during use.

Another object of the invention is to provide a liquid cosmetic container and applicator that eliminates the need for repeatedly dipping the applicator into the container to reload it with product.

Another object of the invention is to provide a liquid cosmetic product applicator where the applicator and container are in one piece while the cosmetic product is being applied to the desired surface.

Another object of the invention is to provide a unitary cosmetic product applicator having the capability of properly controlling the amount of cosmetic product to be applied to the desired surface.

SUMMARY OF THE INVENTION

The invention comprises a device for storing and applying cosmetic product comprising a container having a neck with engaging means on the outer surface thereof, and a cap for the container having a top end and a bottom end, the cap having affixed thereto a rod and applicator, wherein the rod is a hollow stem having a proximal and distal end, wherein the proximal end is attached to the cap inner surface and the distal end has an applicator affixed thereto; wherein the top end and bottom end of the cap have inner and outer surfaces, wherein the bottom end inner surface of the cap contains an engaging means designed to mate with the engaging means on the outer surface of the container neck when the container is in the closed position, causing the applicator to be immersed in the cosmetic; and the top end inner surface of the cap contains an engaging means designed to mate with the engaging means on the outer surface of the container neck to form a unitary application device when the applicator is being used to apply cosmetic to a substrate.

DETAILED DESCRIPTION OF THE DRAWINGS

The First Embodiment

Figure 1:
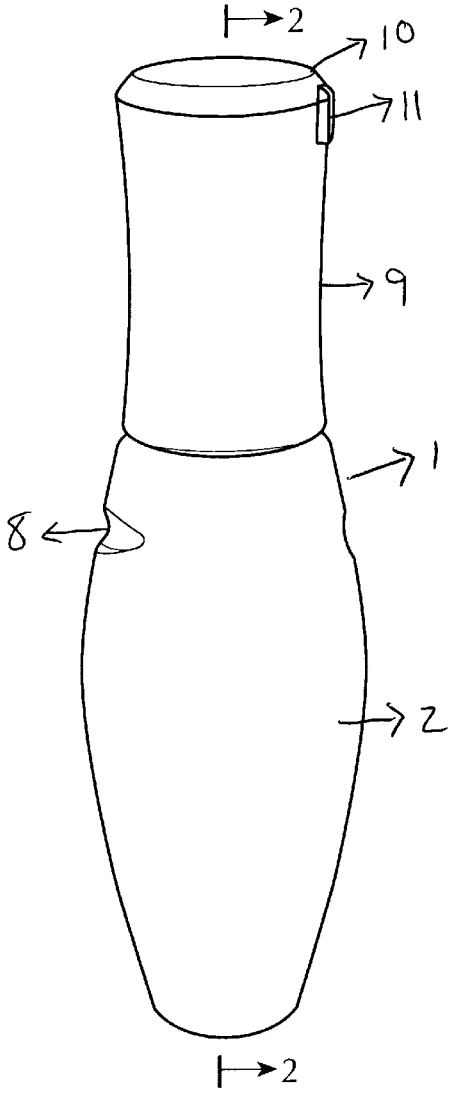
FIG. 1: is a perspective view of one embodiment of the device in the closed position.
Figure 2:
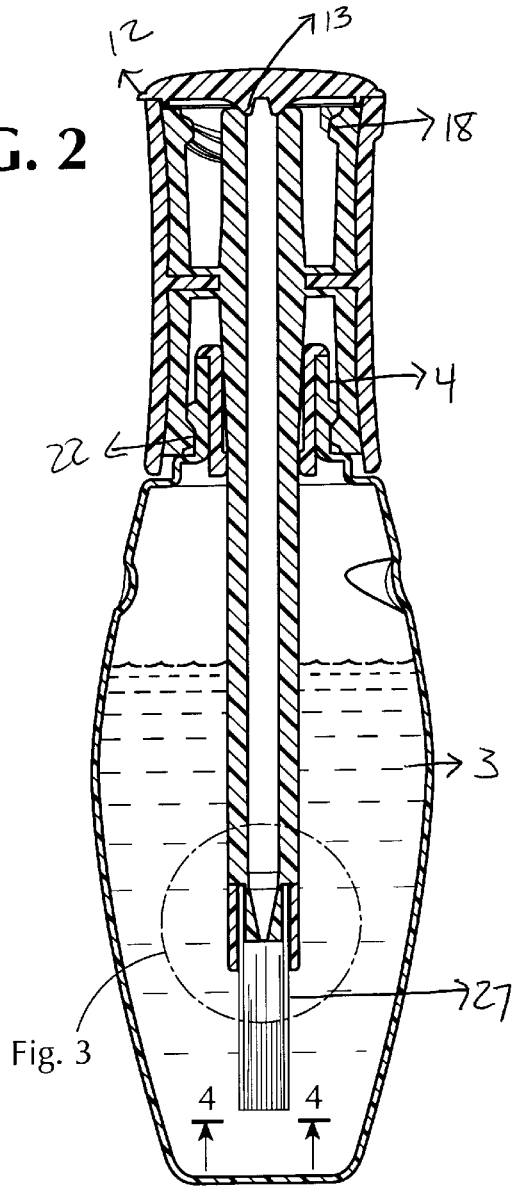
FIG. 2: is a cross-sectional view of the device of FIG. 1 taken across 2—2 of FIG. 1.
Figure 3:
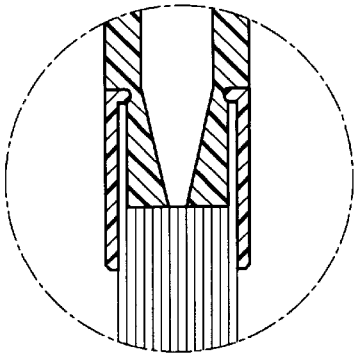
FIG. 3: is an enlarged view of the distal end of the applicator assembly taken from the circled area of FIG. 2.
Figure 4:
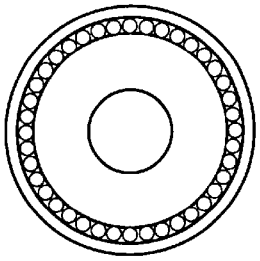
FIG. 4: is an enlarged cross-sectional view taken across 4—4 of FIG. 2.
Figure 5:
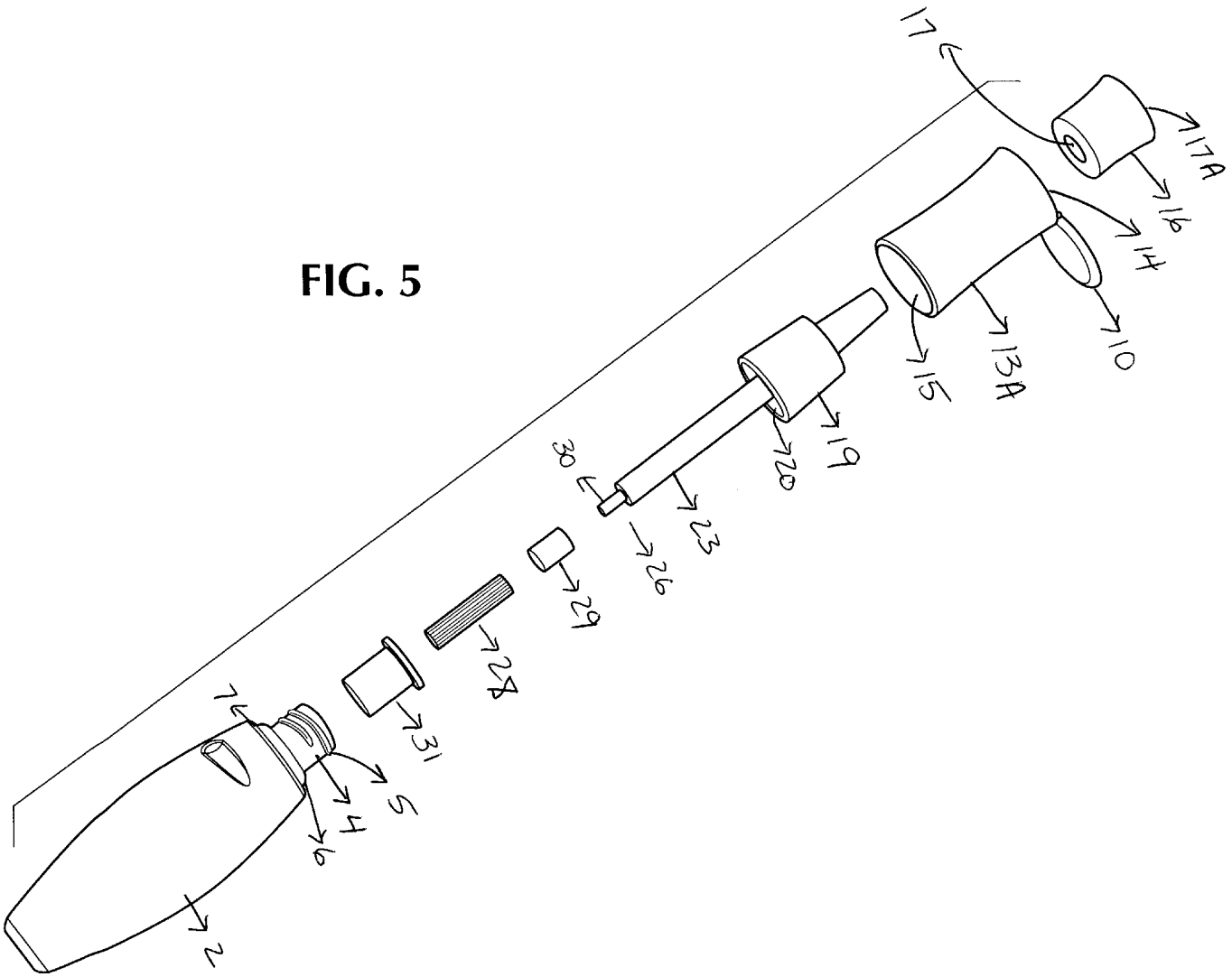
FIG. 5: is an exploded view of the device of FIG. 1.

FIG. 1 is a perspective view of the device 1 in the closed position. The device 1 comprises a container 2 for holding the cosmetic product 3, which may be in the form of a liquid, semi-solid, or solid (e.g. powder). The cosmetic may be makeup, blush, eyeshadow, nail enamel, and the like. Preferably, the cosmetic product is a liquid product, more preferably the cosmetic product 3 is nail enamel. The container 3 has a neck 4 having an engaging means 5. The engaging means 5 may be a threaded engaging means as depicted in FIG. 5, or it may be in the form of a snap fitment. The neck 4 may also have affixed thereto a shoulder 6 that slopes downwardly to terminate in a ledge 7 that forms the top outer surface of the container 2. The container 2 may contain a depression 8 in the outer surface thereof.

Figure 6:
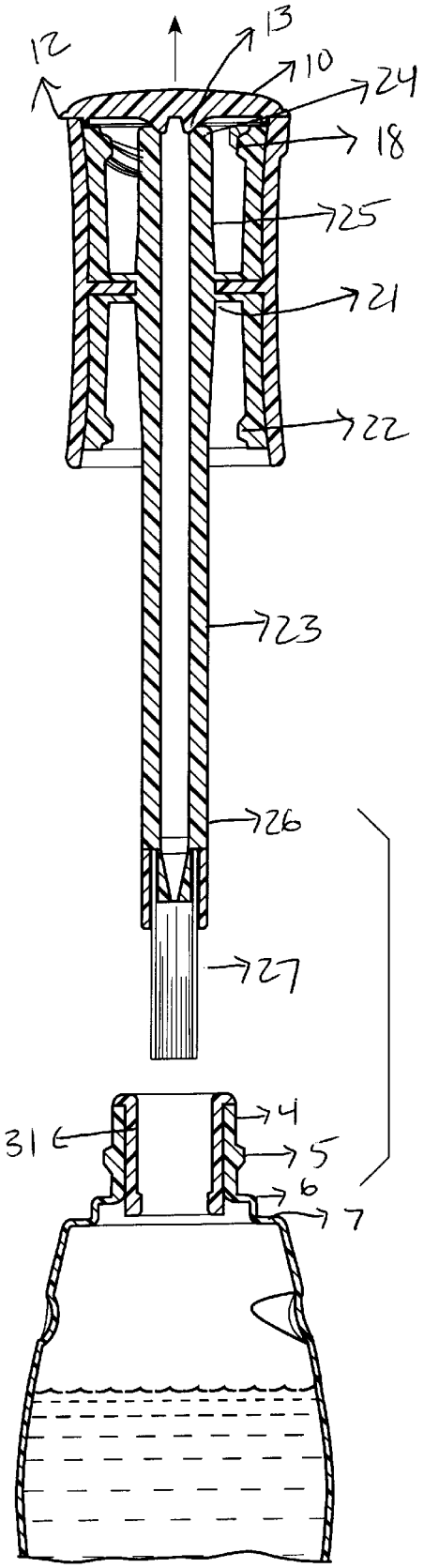
FIG. 6: is a partial, exploded, cross-sectional view of the device with the cap/rod/applicator assembly withdrawn from the container.
Figure 7:
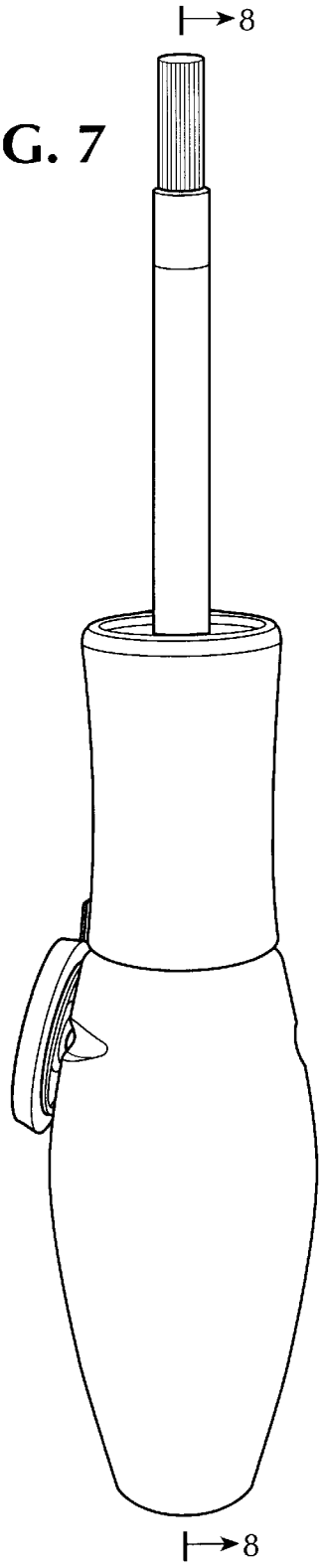
FIG. 7: is a perspective view of the device showing the cap affixed to the container when the device is being used to apply cosmetic product.
Figure 8:
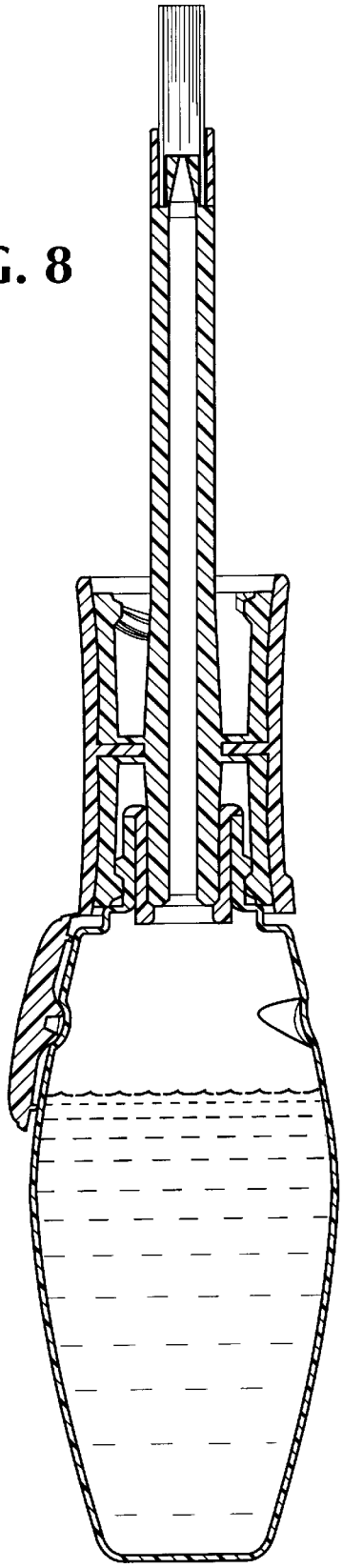
FIG. 8: is a cross-sectional view taken across 8—8 of FIG. 7.

The container 2 has a cap 9 that has a releasable lid 10. The cap may be in the form of a cylinder, a square, or any other shape so long as it is able to serve as a closure to container 2. Preferably, the cap is in the form of a cylindrical sleeve 13A. The releasable lid 10 is affixed to the cap 9 by means of a living hinge 11 that permits the cap to open and close. It is noted that in addition to the living hinge, other types of hinges are suitable such as pins or spring hinges. The releasable lid 10 may contain a slight protrusion 12 on the outer surface thereof, that enables the user to grip the protrusion 12 with the fingers to open the lid 10. The releasable lid 10 may contain on the inner surface thereof two protrusions 13. The protrusions 13 are designed to fit into the depression 8 in the outer surface of the container 2 when the cap 9 is removed from the container 2 as shown in FIG. 6, and re-affixed to the container 2 as shown in FIG. 7. In one preferred embodiment of the invention, the cap 9 is formed from a cylindrical sleeve 13A having a top end 14 and a bottom end 15. A shell 16 is fitted into the top end 14 of the cylindrical sleeve 13A. The shell has an open upper end 17A and an orifice 17. On the inner surface of the open upper end 17A of the shell 16 there are engaging means 18 designed to mate with the engaging means 5 on the neck 4 of the container 2. The engaging means 18 may be threaded or may be in the form of a snap fitment. The bottom end 15 of the cylindrical sleeve 13A forming the cap 9 contains a shell 19 which is fitted into the cylindrical sleeve 13A, similar to shell 16 found at the top end 14 of the cap 9. The shell 19 contains an open lower end 20 and an orifice 21. On the inner surface of the open lower end 20 of the shell 19 are engaging means 22 designed to mate with the engaging means 5 on the container 2 neck 4. There is a hollow stem 23 which fits through orifice 17 of shell 16 and the orifice 21 of shell 19. Shells 16 and 19 fit into cap 9 such that orifice 17 of shell 16 abuts orifice 21 of shell 19 permitting hollow stem 23 to fit therethrough as depicted in FIG. 6. The hollow stem 23 may be permanently affixed to shell 16 and shell 19, if desired. Or hollow stem 23 may be friction fitted to shell 16 and shell 19 through orifices 17 and 21 respectively. Preferably, protrusions 13 abut the top inner surface 24 of the proximal end 25 of hollow stem 23 to form an air tight seal. The hollow stem 23 has a distal end 26 having affixed thereto an applicator which is preferably a brush 27. The brush 27 is formed by bristles 28 which are held together by means of a grip 29 which secures the bristles 28 of the brush 27. The hollow stem 23 preferably has a restriction 30 which controls the amount of liquid cosmetic product delivered to the brush 27. Preferably, a wiper 31 is inserted into the neck 4 of the container 2. The wiper 31 acts to wipe excess cosmetic product 3 from the stem 23 as the stem 23 is pulled through the wiper 31.

Figure 9:
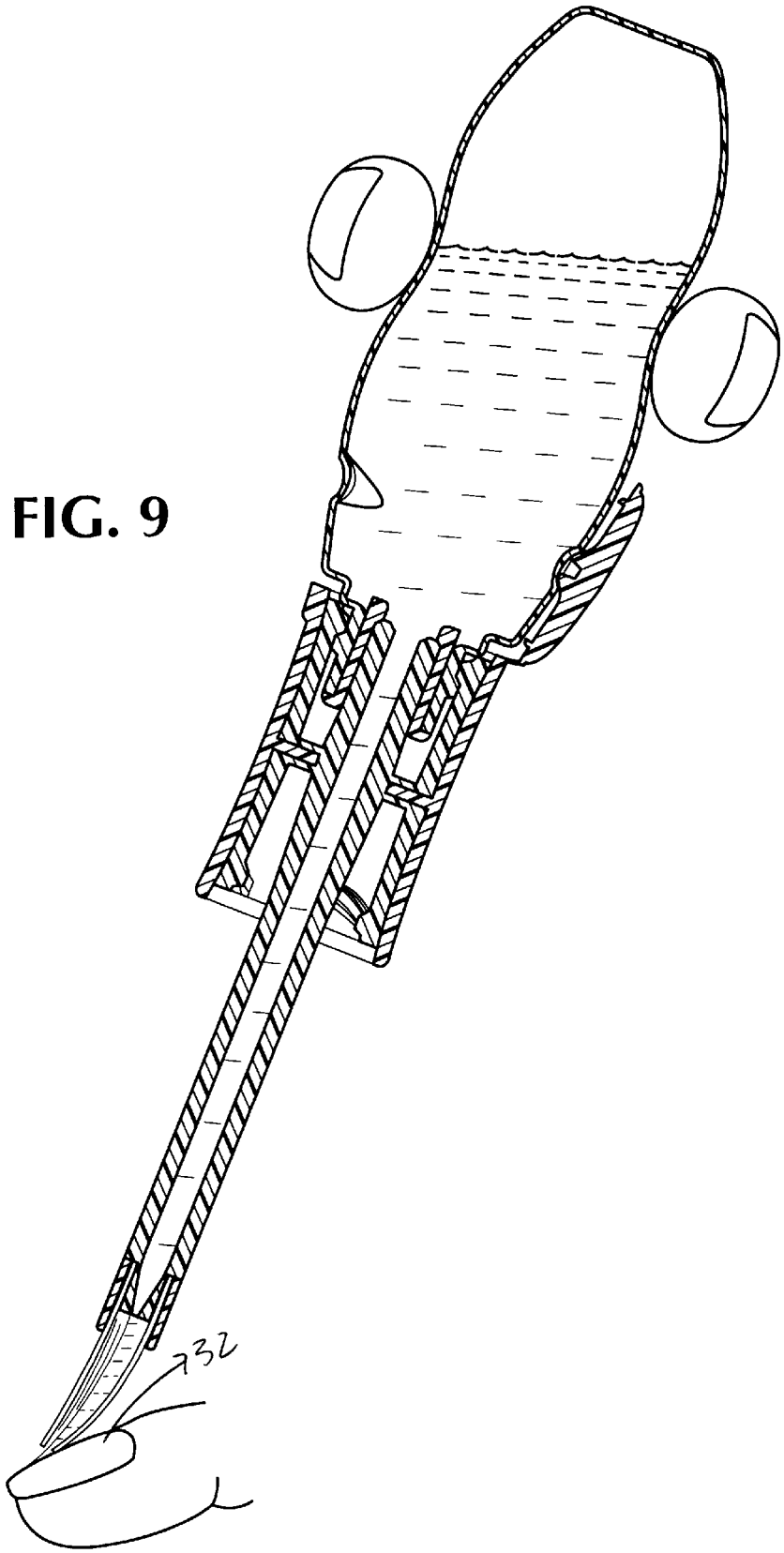
FIG. 9: illustrates the used of the device of FIG. 8 to paint fingernails.

When the user of the device 1 wishes to apply the liquid cosmetic product 3, the user removes the cap 9 from the container by turning the cap 9 so that the engaging means 22 on the cap 9 disengage from the engaging means 5 on the container 2 neck 4. The user then snaps off the releasable lid 10 on the cap 9, and inverts the cap 9, then affixes the upper end of the cap 9 to the container 2 by mating the engaging means 18 with the engaging means 5 on the container 2 neck 4. FIG. 6 illustrates the removal of the cap 9 from the container 2. FIG. 7 illustrates how the releasable lid 10 is removed and the cap 9 is inverted and affixed to the container 2 to form an applicator system for the liquid cosmetic product 3. The user then uses the device 1 to apply cosmetic. FIG. 9 illustrates the application of polish to the nails 32 using the device. After the user is finished, the cap 9 is removed from the container by disengaging the engaging means 18 from engaging means 5. The releasable lid 10 is closed and the cap 9 is then replaced and the container 2 is as depicted in FIG. 1.

The Second Embodiment

Figure 10:
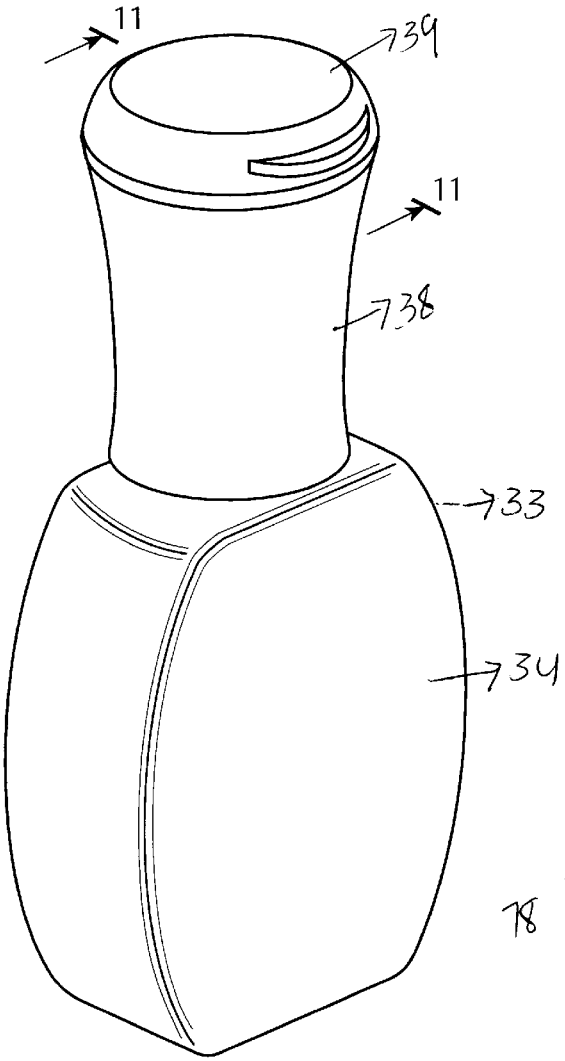
FIG. 10: is a perspective view of a second device in accordance with another embodiment of the invention.

The second embodiment of the invention is depicted in FIGS. 10–14. FIG. 10 illustrates a device 33 in the closed position showing a container 34 for containing cosmetic 35

The device may be made of any suitable material used in the manufacture of cosmetic applicators and containers. The container may be glass, a synthetic thermoplastic materials such as styrene, polyethylene, butadiene, and the like. If desired the container may be of one material and the cap/rod/applicator may be made of other materials. The device enables metered dose application of cosmetic liquid to the desired substrate, e.g. the amount of cosmetic delivered to the substrate is appropriate for the area to be covered. As with embodiment 1, the device may be used to apply a wide variety of cosmetic products that are liquids ore solids, including but not limited to nail enamel, blush, eyeshadow, and the like.

Figure 14:
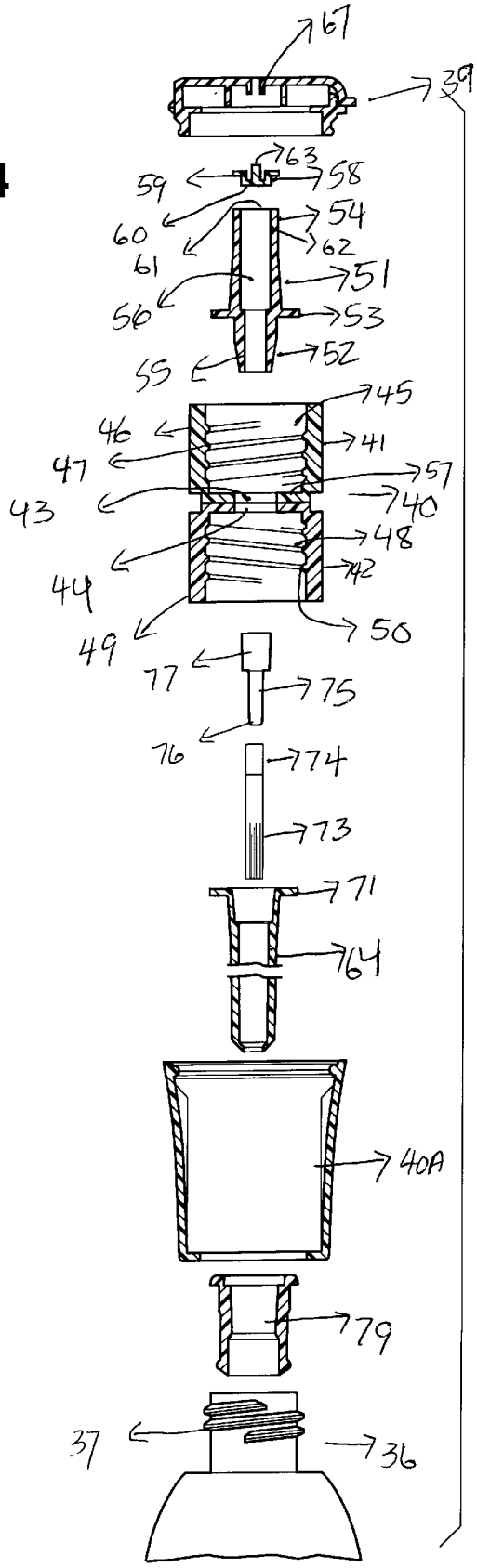
FIG. 14: is a partial, exploded, cross-sectional view of the device of FIG. 10.

The container 34 has a neck 36 having an engaging means 37 on the outer surface thereof The engaging means 37 may be as depicted in FIGS. 10–14, or it may be in the form of a snap fitment. The container 34 has a cap 38 that has a releasable lid 39. The cap 38 may be in the form of a cylinder, a square, or other shape, so long as it is able to serve as a closure to container 34. Preferably, the cap is in the form of a cylindrical sleeve 40A. Fitted inside the cylindrical sleeve are cylindrically shaped pieces, 41 and 42, that are placed in abutment as shown in FIG. 14. If desired, the cylindrical shaped pieces 41 and 42 may be designed to friction fit within external sleeve 40A. The cylindrical piece 41 preferably has an orifice 43 and cylindrical piece 42 preferably has an orifice 44, and orifices 43 and 44 are placed in abutment as shown in FIG. 14, so that liquid may traverse through the opening formed when the two orifices 43 and 44 are placed in abutment. Cylindrical piece 41 has an inner surface 45 and outer surface 46, and on the inner surface 45 are engaging means 47 that are designed to mate with engaging means 37 found on the neck 36 of the container 34. Similarly, cylinder 42 has an inner surface 48 and an outer surface 49, and on the inner surface 48 are engaging means 50 designed to mate with engaging means 37 on the neck 36 of container 34. Cylindrical pieces 41 and 42 are held in abutment by a nozzle 51, which is also cylindrical shaped. The nozzle 51 has a bottom portion 52, a platform 53, and a top portion 54. The sidewalls 55 of the bottom portion 52 have a circumference that permits the bottom portion to fit into and through the orifices 43 and 44 to form a channel 56 for passage of the cosmetic product 35 and hold cylindrical pieces 41 and 42 in abutment within the cylindrical sleeve 40A, forming the cap 38 of the container 34. The platform 53 rests against the bottom inner surface 57 of cylinder piece 41. A plug 58 is designed to fit into the top portion 54 of nozzle 51 to form a closure. The plug 58 preferably has two protrusions 59 on either side, causing the bottom portion 60 of the plug 48 to fit within the orifice 61 formed between the sidewalls 62 of the top portion 54 of the nozzle 51. A peg 63 is found on the top of the plug 58.

The container 34 has a cap 38 that has a releasable lid 39. The lid 39 is anchored to the cap 38 by a living hinge 65 that permits the cap 38 to open and close. The releasable lid 39 may contain a slight protrusion 66 on the outer surface thereof, that enables the user to grip the protrusion 66 with the fingers to open the lid 39. The releasable lid 39 may contain on its inner surface two protrusions 67. These protrusions 67 are designed to mate with the peg 63 on the plug 58 when the releasable lid 39 is in the closed position.

Figure 12:
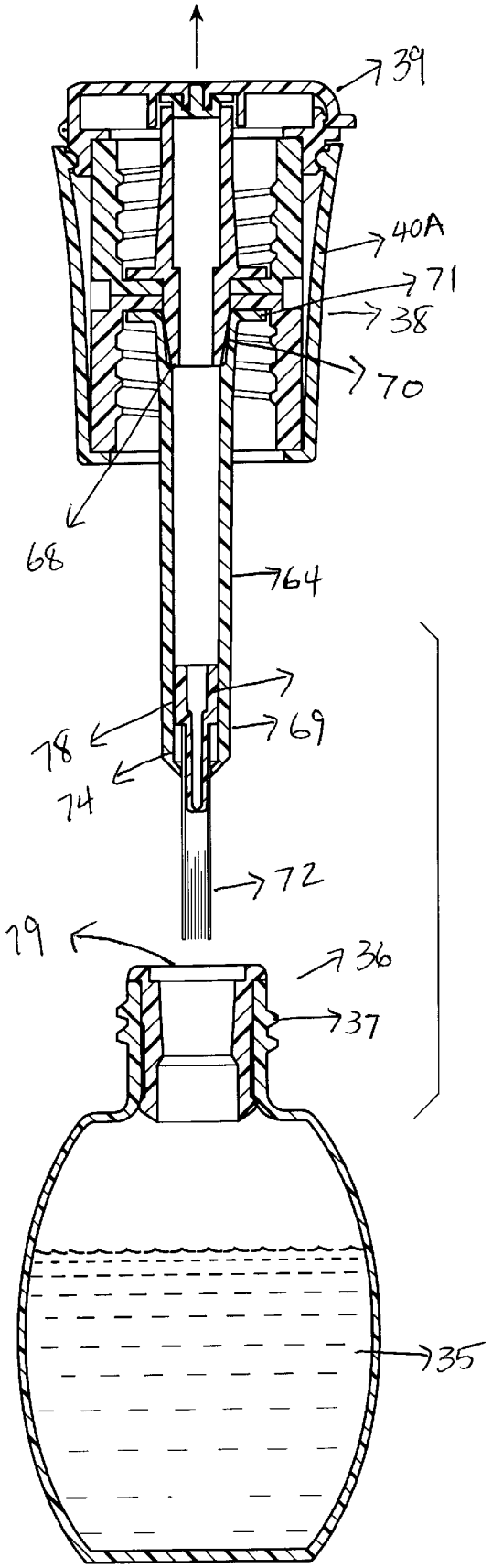
FIG. 12: is an exploded view of the device of FIG. 11.
Figure 13:
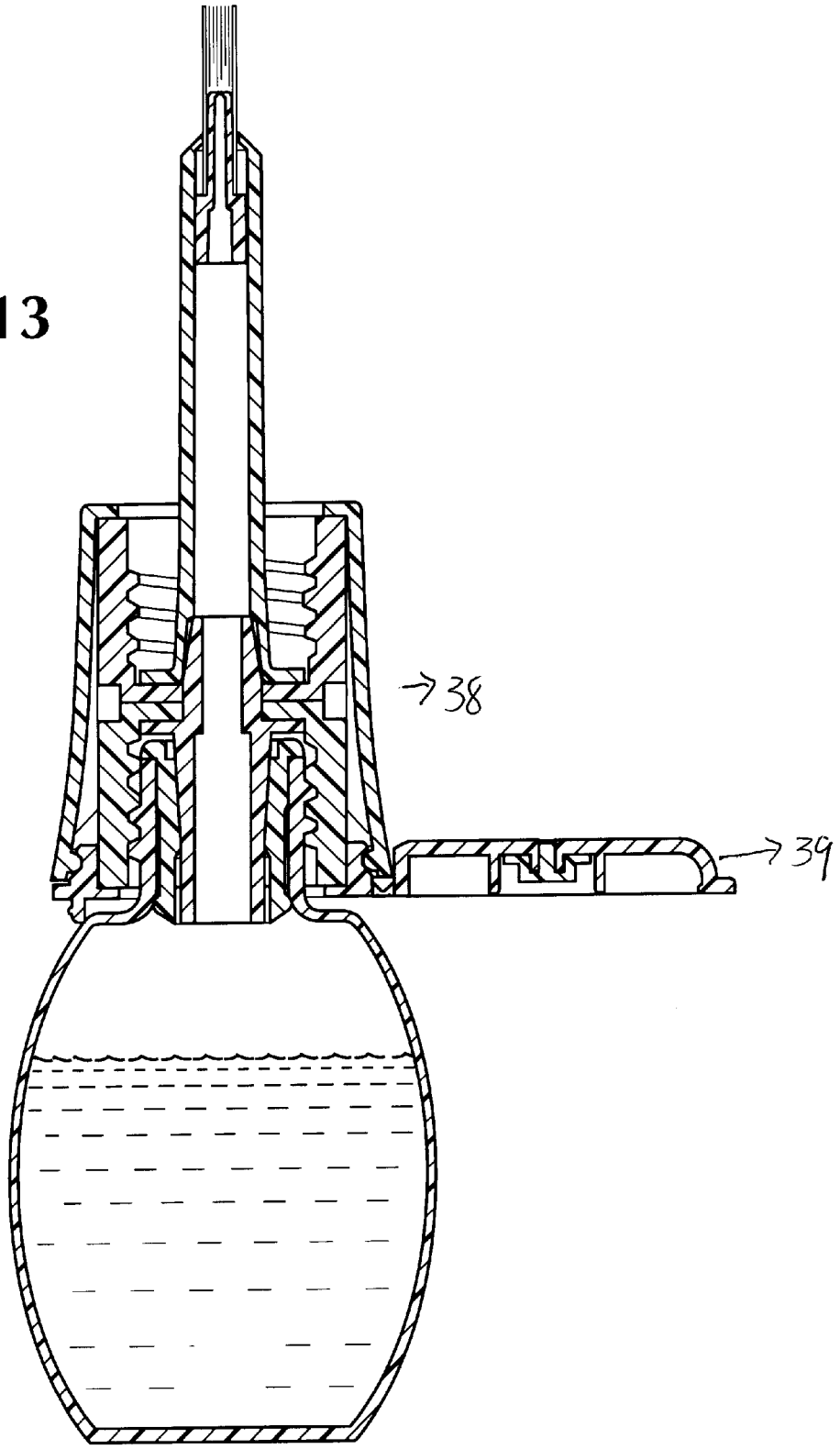
FIG. 13: is a cross-sectional view of the device of FIG. 10 showing the cap affixed to the container when the device is used to apply cosmetic product.

There is a hollow stem 64 (see FIG. 12) which is shown in broken view in FIG. 14. The hollow stem 64 has a proximal end 68 and a distal end 69. The sidewalls 70 of the proximal end 68 of the hollow stem 64 may diverge outwardly to form a platform 71. The hollow stem 64 is of a circumference sufficient to permit the bottom portion 52 of the nozzle 51 to fit inside the proximal end 68 of the hollow stem 64. Attached to the distal end 69 of hollow stem 64 is a brush 72 comprised of individual bristles 73 held together in a sheaf by means of a grip 74. Preferably, the grip 74 in the form of a ringe. A feeder piece 75 having a lower end 76 and an upper end 77 is designed to mate with the grip 74 such that the lower end 76 of the feeder piece 75 has a circumference that is slightly smaller than the internal diameter of the grip 74, permitting the lower end 76 to slide inside the grip 74. The upper end 77 of the feeder piece, has a circumference that is slightly larger than the circumference of the grip 74, so that when the lower end 76 of the feeder piece 75 is fed into the grip 74 the upper end 77 of the feeder piece 75 forms a stop preventing the entire feeder piece 75 from moving within the grip 74. The grip 74, bristles 73 and feeder piece 75, together form the brush assembly 78. The brush assembly 78 fits into the distal end 69 of the hollow stem 64 as depicted in FIG. 12.

It may be desirable to include a wiper 79 in the neck 36 of the container 34. The wiper 79 is capable of wiping excess cosmetic from the brush assembly 78 as it is extracted from the container 34 by the consumer.

Figure 11:
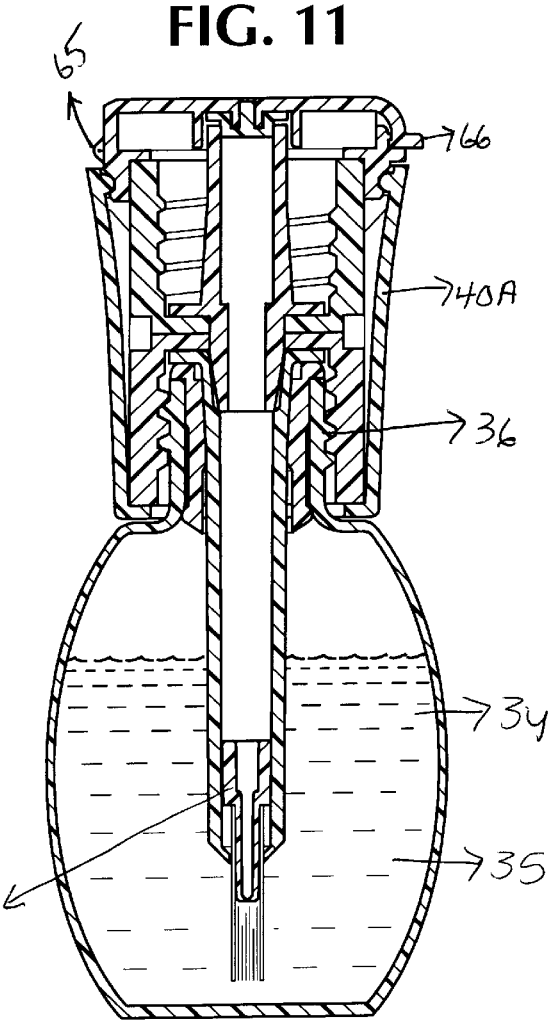
FIG. 11: is a cross-sectional view taken across FIG. 11—11 of FIG. 10.

When the user wishes to apply the cosmetic product 35, the user removes the cap 38 from the container 34 by turning the cap 38 so that the engaging means 50 on the inner surface of cylindrical piece 42 are disengaged from the engaging means 37 on the neck 36 of container 34. FIG. 11 is a cross-sectional view of the container of FIG. 10 taken across 11—11, illustrating the container in the closed position. FIG. 12 illustrates removal of the cap 38 from the container 34, and extraction of the hollow stem 64 and brush assembly 78 from the container 34. The consumer then affixes the applicator device to the container 34 in the manner illustrated in FIG. 13, by engaging the engaging means 47 on the inner surface of cylindrical piece 41 to the engaging means 37 found on the neck 36 of the container 34. The user then uses the device to apply cosmetic. When the user is finished, the cap 38 is removed from the container 34 by disengaging the engaging means 47 from engaging means 37. The cap 38 is then replaced and the container 34 is as depicted in FIG. 10.

The claimed device provides a simple, convenient method for applying and storing cosmetic and providing unit dose dispensing thereof.

We claim:

1. A device for storing and applying cosmetic product comprising a container having a neck with engaging means on the outer surface thereof, and a cap for the container formed from a cylindrical sleeve, said cap having a top end and a bottom end, the cap having affixed thereto a rod and applicator, wherein the rod is a hollow stem having a proximal and distal end, wherein the proximal end is attached to the cap inner surface and the distal end has an applicator affixed thereto; wherein the top end and bottom end of the cap have inner and outer surfaces, wherein the bottom end inner surface of the cap contains threaded engaging means designed to mate with the engaging means on the outer surface of the container neck when the container is in the closed position, causing the applicator to be immersed in the cosmetic liquid; and the top end inner surface of the cap contains engaging means designed to mate with the engaging means on the outer surface of the container neck to form a unitary application device when the applicator is being used to apply cosmetic to a substrate, and wherein the top end of the cap contains a releasable lid affixed thereto which opens and closes said cap, said lid containing protrusions which close the proximal end of the hollow stem and form an airtight seal when the releasable lid is in the closed position.

2. The device of claim 1 wherein the cylindrical sleeve contains a shell fitted into the top end of the cylindrical sleeve and a shell fitted into the bottom end of the cylindrical sleeve.

3. The device of claim 2 wherein the shell fitted into the top end of the cylindrical sleeve has an open upper end and an orifice, and the shell fitted into the bottom end of the cylindrical sleeve has an open lower end and an orifice.

4. The device of claim 3 wherein the shell fitted into the top end of the cylindrical sleeve has an inner surface and an outer surface, and on the inner surface are the threaded engaging means on the top end inner surface of the cap designed to mate with said engaging means on the outer surface of the container neck when the container is being used to apply cosmetic.

5. The device of claim 3 wherein the shell fitted into the bottom end of the cylindrical sleeve has an inner surface and an outer surface, and on the inner surface are the threaded engaging means on the bottom end inner surface of the cap designed to mate with the engaging means on the outer surface of the container neck when the container is in the closed position.

6. The device of claim 3 wherein the hollow stem of the applicator fits into the orifice of the shell fitted into the top end of the cylindrical sleeve, and the orifice of the shell fitted into the bottom end of the cylindrical sleeve.

7. The device of claim 6 wherein the applicator is a brush applicator.

8. The device of claim 7 wherein the applicator is a nail enamel brush.

9. The device of claim 7 wherein the hollow stem has a restriction that controls the amount of cosmetic product delivered to the brush.

10. The device of claim 1 wherein the releasable lid has a slight protrusion on the outer surface thereof, that enables the user to grip the protrusion with the fingers to open the lid.

11. The device of claim 1 wherein the cosmetic product is a liquid, solid, or semi-solid.

12. The device of claim 11 wherein the cosmetic product is a liquid.

13. The device of claim 12 wherein the cosmetic product is nail enamel.

14. The device of claim 1 which contains a wiper within the container neck which removes excess cosmetic from the applicator as it is removed from the container.

* * * * *